US007832698B2

(12) United States Patent
Chang

(10) Patent No.: US 7,832,698 B2
(45) Date of Patent: Nov. 16, 2010

(54) MOUNTING BASE FOR FIXING TO SWIMMING POOL PERIMETER MOUNTING BASE FOR FIXING TO SWIMMING POOL PERIMETER

(76) Inventor: Chih-Ming Chang, No. 1, Daguhuwan Avenue, Hualien City, Hualien County 970 (TW)

( * ) Notice: Subject to any disclaimer, the term of this patent is extended or adjusted under 35 U.S.C. 154(b) by 879 days.

(21) Appl. No.: 11/785,852

(22) Filed: Apr. 20, 2007

(65) Prior Publication Data

US 2008/0256699 A1 Oct. 23, 2008

(51) Int. Cl.
*E04G 3/00* (2006.01)

(52) U.S. Cl. ..... 248/278.1; 248/188.6; 248/276.1; 248/295.11; 473/466

(58) Field of Classification Search ..... 248/201, 248/188.1, 188.6, 276.1, 278.1, 235, 240, 248/241, 295.11; 473/466
See application file for complete search history.

(56) References Cited

U.S. PATENT DOCUMENTS 4,183,489 A * 1/1980 Copher et al. ..... 248/278.1
4,872,230 A * 10/1989 Levine ..... 7/100
5,603,486 A * 2/1997 Liu ..... 254/8 B
5,950,990 A * 9/1999 Castillo ..... 254/126
7,086,192 B2 * 8/2006 Deros ..... 42/94
2008/0236945 A1 * 10/2008 Larouche et al. ..... 182/153

* cited by examiner

*Primary Examiner*—Anita M King
*Assistant Examiner*—Michael McDuffie
(74) *Attorney, Agent, or Firm*—Birch, Stewart, Kolasch & Birch, LLP

(57) ABSTRACT

A mounting base includes two fixing plates movably connected to each other via a four-bar mechanism, which consist of four fixing arms and is controllable via an adjusting rod to reduce one diagonal thereof, so that the two fixing plates located at two opposite ends of the other diagonal of the four-bar mechanism are moved outward to firmly press against two opposite inner wall surfaces of a swimming pool gutter, enabling the mounting base to be conveniently and safely fixed to any desired point along a swimming pool perimeter without spoiling the swimming pool. A carrier plate is associated with the adjusting rod for a water activity facility to mount thereon. A second carrier plate perpendicular to the first carrier plate may be associated with the fixing plates via another two pivotally connected fixing arms, so that the mounting base is usable in two different directions.

8 Claims, 4 Drawing Sheets

MOUNTING BASE FOR FIXING TO SWIMMING POOL PERIMETER MOUNTING BASE FOR FIXING TO SWIMMING POOL PERIMETER

FIELD OF THE INVENTION

The present invention relates to a mounting base for fixing to swimming pool perimeter, and more particularly to a mounting base that can be freely fixed to any desired point along a swimming pool perimeter for supporting a water activity facility thereon.

BACKGROUND OF THE INVENTION

People will go to swimming pools in hot days. In addition to swimming, there are also many other water activities that can be carried out in a swimming pool, such as water volleyball, water basketball, swimming training, etc. To play water volleyball or water basketball, net posts or support unit must be set up at swimming pool perimeter. In swimming training, it might be necessary to erect a swimming training machine close to the swimming pool perimeter. Some of the existing ways for erecting such water activity facilities at the swimming pool perimeter include the provision of water-filled bases to carry or support the water activity facilities, and the drilling of holes on the ground surrounding the swimming pool for locking the water activity facilities thereto with screws. The water-filled bases have a relatively large volume and are therefore not convenient for use. The big water-filler bases also form dangerous obstacles and unpleasant scenes at the swimming pool. To drill holes on the ground surrounding the swimming pool is troublesome and would spoil the environment beauty of the swimming pool; and it is impractical to arbitrarily drill the ground surrounding the swimming pool.

It is therefore tried by the inventor to develop a mounting base that can be freely fixed to any desired point along the swimming pool perimeter without spoiling the environment beauty of the swimming pool while allowing a heavy water activity facility to be conveniently and safely mounted thereon.

SUMMARY OF THE INVENTION

A primary object of the present invention is to provide a mounting base that can be freely fixed to any desired position in a swimming pool gutter via a four-bar mechanism, so that a water activity facility can be freely set up along a swimming pool perimeter by mounting the facility to the mounting base.

Another object of the present invention is to provide a mounting base that allows a water activity facility to be safely set up at any desired position along a swimming pool perimeter without spoiling the environment beauty of the swimming pool.

To achieve the above and other objects, the mounting base for fixing to swimming pool perimeter according to the present invention includes two fixing plates; a first set of two fixing arms, which are pivotally connected at respective first end to each other to form a first pivot point thereat, on which a through hole is provided, and separately pivotally connected at respective second end to an inner side of the two fixing plates; a second set of two fixing arms; which are pivotally connected at respective first end to each other to form another first pivot point thereat, on which an internally threaded through hole is provided, and separately pivotally connected at respective second end to an inner side of the two fixing plates; an adjusting rod being provided at an end with a push head and at the other opposite end with an externally threaded section; and a first carrier plate associated with the push head of the adjusting rod. Whereby when the adjusting rod is turned at the push head, the threaded section of the adjusting rod is extended through the through hole and screwed into the threaded hole on the two first pivot points with the push head pushed against the first pivot point of the first set of two fixing arms, and the two fixing plates are moved outward to firmly press against two opposite inner wall surfaces of a gutter extended along the swimming pool perimeter, bringing the mounting base to be firmly fixed to the gutter with the first carrier plate ready for carrying or supporting a water activity facility thereon.

For the mounting base of the present invention to be usable in different directions, a second carrier plate perpendicular to the first carrier plate may be further associated with the fixing plates via another set of two fixing arms which are pivotally connected at an end to each other and at the other end to the two fixing plates.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
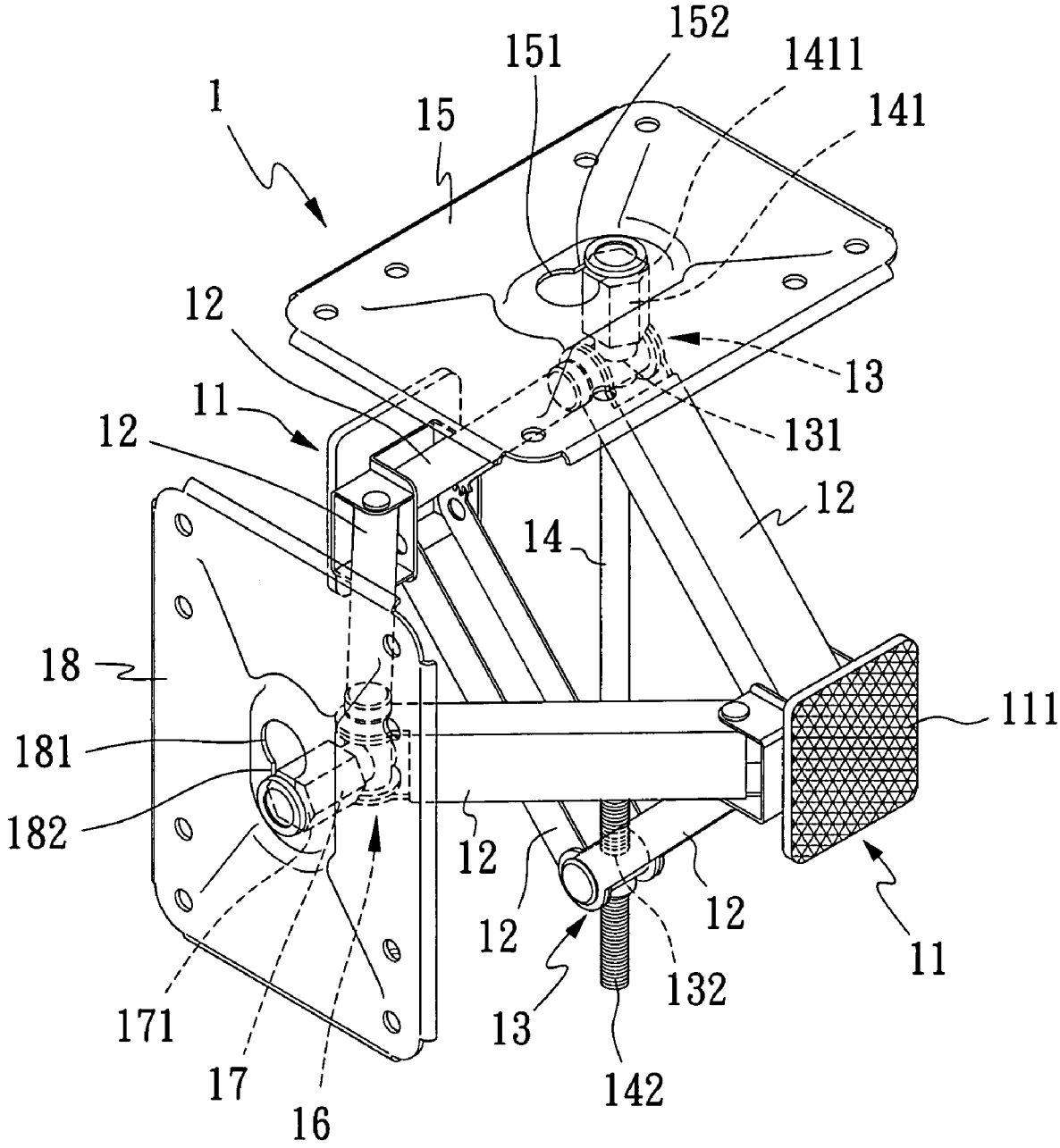
FIG. 1 is a perspective view of a mounting base for fixing to swimming pool perimeter according to a preferred embodiment of the present invention.
Figure 2:
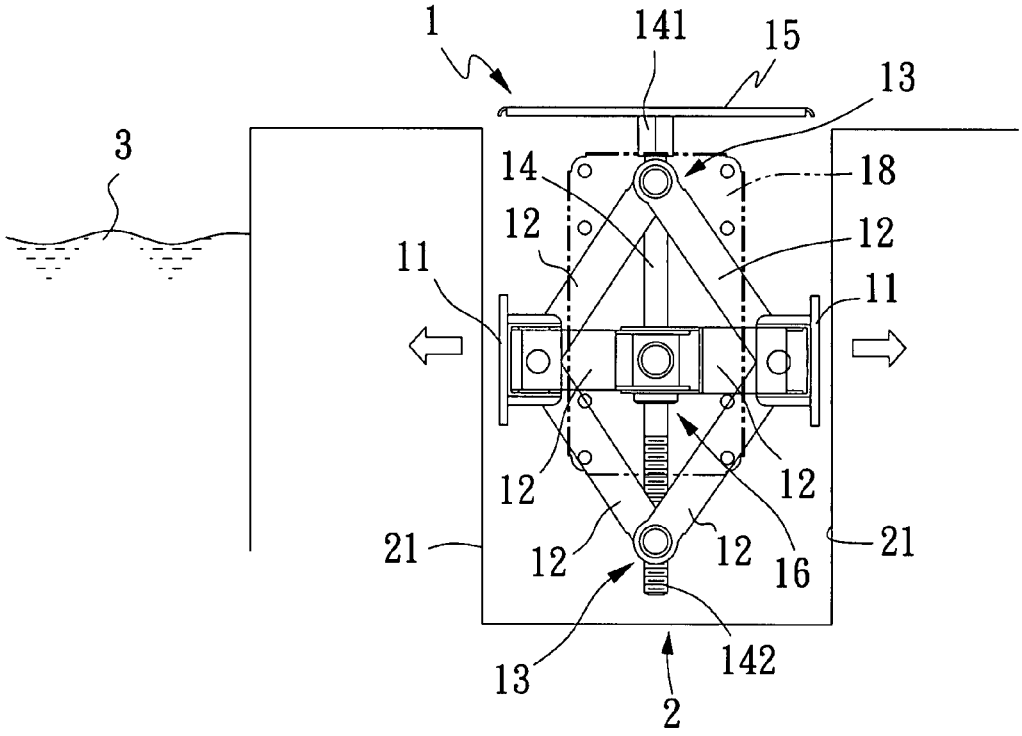
FIGS. 2 and 3 are sectioned side views showing one manner of fixing the mounting base of FIG. 1 to a swimming pool gutter.
Figure 3:
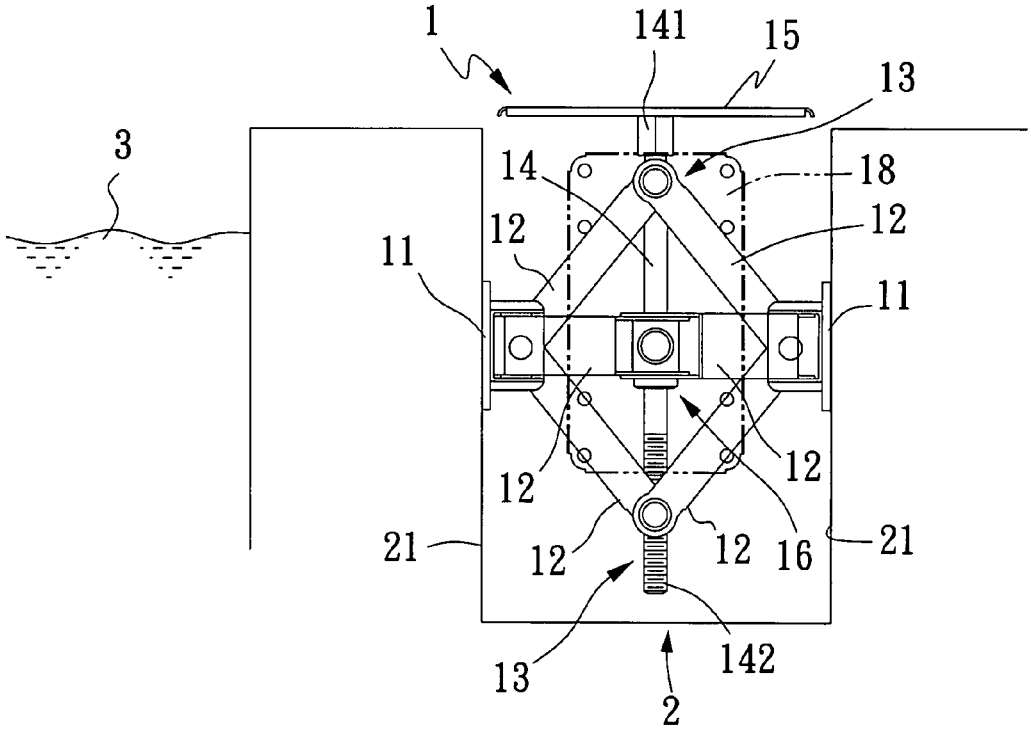

Please refer to FIG. 1 that is a perspective view of a mounting base 1 for fixing to swimming pool perimeter according to a preferred embodiment of the present invention, and to FIGS. 2 and 3 that are sectioned side views showing one manner of fixing the mounting base 1 to a gutter 2 extended along a perimeter of a swimming pool 3. As shown, the mounting base 1 includes two fixing plates 11 having an inner and an outer side each, six fixing arms 12 having a first and a second end each, an adjusting rod 14, a first carrier plate 15, and a second carrier plate 18.

A first two of the six fixing arms 12 are pivotally connected to each other at their first end to form a first pivot point 13 thereat, and separately pivotally connected at their second end to the inner side of the two fixing plates 11; and a second two of the six fixing arms 12 are pivotally connected to each other at their first end to form another first pivot point 13 thereat, and separately pivotally connected at their second end to the inner side of the second fixing plate 11; such that the four fixing arms 12 connected to the two fixing plates 11 are coplanar. On the first pivot point 13 formed at the first end of the first set of two fixing arms 12, there is provided a through hole 131; and on the other first pivot point 13 formed at the first end of the second set of two fixing arms 12, there is provided an internally threaded hole 132. The two fixing plates 11 are provided on their outer side with a coarsened surface 111 each.

The adjusting rod 14 is provided at an end with a hexagonal push head 141, and at the other end with an externally threaded section 142. An annular groove 1411 is formed around the hexagonal push head 141.

The first carrier plate 15 is provided at a predetermined position with a fixing opening 151 and a fixing slot 152 sideward extended from and communicable with the fixing opening 151. The annular groove 1411 on the hexagonal push head 141 is moved into the fixing slot 152 via the fixing opening 151 to engage with the fixing slot 152, so that the first carrier plate 15 is associated with the push head 141.

The last two of the six fixing arms 12 are pivotally connected to each other at their first end to form a second pivot point 16 thereat, and separately pivotally connected at their second end to the inner side of the two fixing plates 11 to adjoin the second ends of the other four fixing arms 12, such that the last two fixing arms 12 are located within another plane perpendicular to the plane containing the other four fixing arms 12. The second pivot point 16 is provided with a hexagonal connecting head 17, around which an annular groove 171 is formed.

The second carrier plate 18 is provided at a predetermined position with a fixing opening 181 and a fixing slot 182 sideward extended from and communicable with the fixing opening 181. The annular groove 171 on the hexagonal connecting head 17 is moved into the fixing slot 182 via the fixing opening 181 to engage with the fixing slot 182, so that the second carrier plate 18 is associated with the connecting head 17.

With the above arrangements, the first and the second carrier plate 15, 18 are movable at the same time but in two perpendicular directions.

To fix the mounting base 1 of the present invention to the swimming pool gutter 2, use a wrench (not shown) to turn the hexagonal push head 141, so that the threaded section 142 of the adjusting rod 14 is extended through the through hole 131 and threaded into the threaded hole 132, and the push head 141 is brought to push against the first pivot point 13 formed at the first end of the first set of two fixing arms 12. At this point, the two fixing plates 11 are caused to move outward to press the coarsened surfaces 111 against two opposite inner wall surfaces 21 of the swimming pool gutter 2, enabling the whole mounting base 1 to be firmly fixed to the gutter 3. The coarsened surfaces 21 enhance the frictional contact between the fixing plates 11 and the gutter wall surfaces 21, so that the mounting base 1 can be more stably fixed to the gutter 3.

Figure 4:
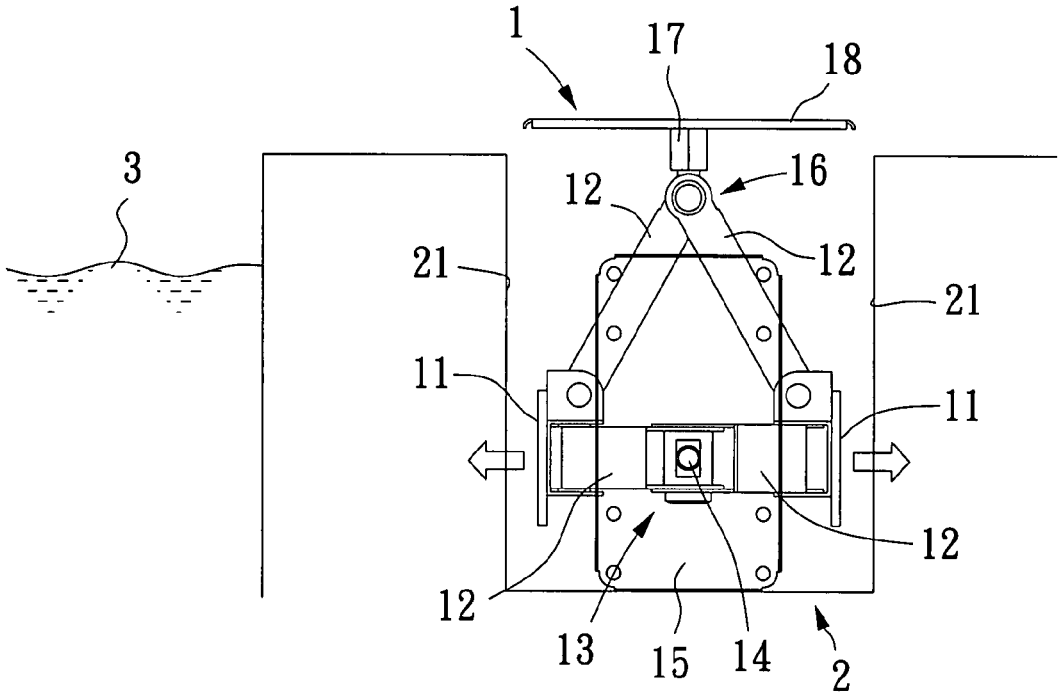
FIGS. 4 and 5 are sectioned side views showing another manner of fixing the mounting base of FIG. 1 to a swimming pool gutter.
Figure 5:
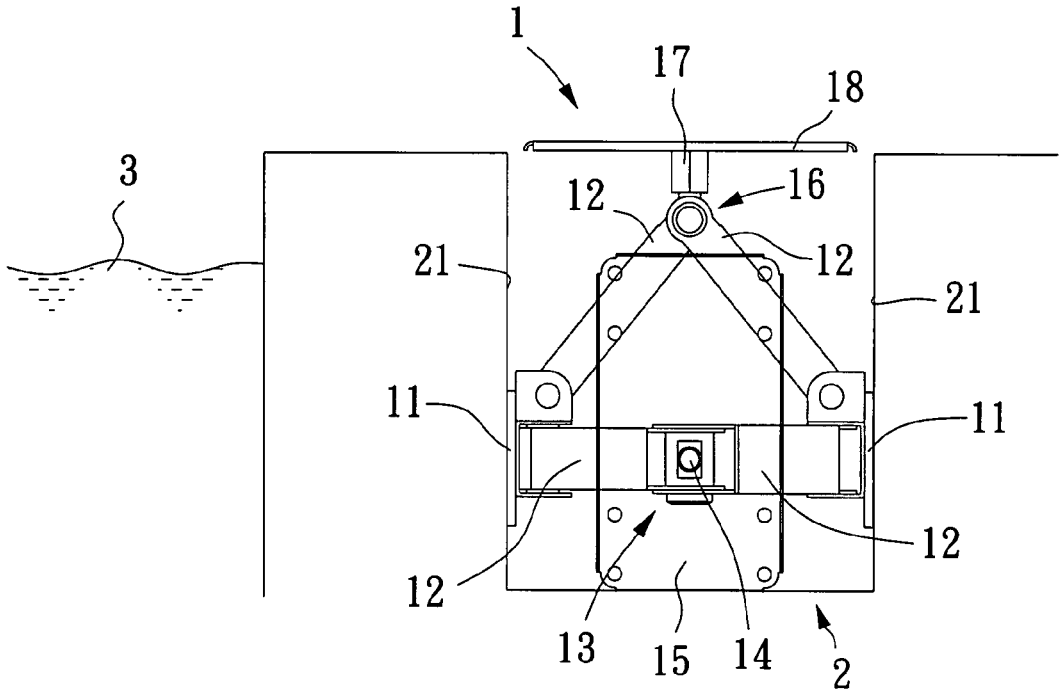

It is noted the fixing of the mounting base 1 to the swimming pool gutter 2 is not restricted to a certain fixed direction as shown in FIGS. 2 and 3. When the gutter 2 extended along the perimeter of the swimming pool 3 has a relatively small depth, the mounting base 1 may be turned about an axis between the two fixing plates 11 for the adjusting rod 14 to extend in a direction parallel with a bottom of the gutter 2, as shown in FIGS. 4 and 5. Then, the mounting base 1 may be fixed to the gutter 2 in the same steps as described in the preceding paragraph.

Figure 6:
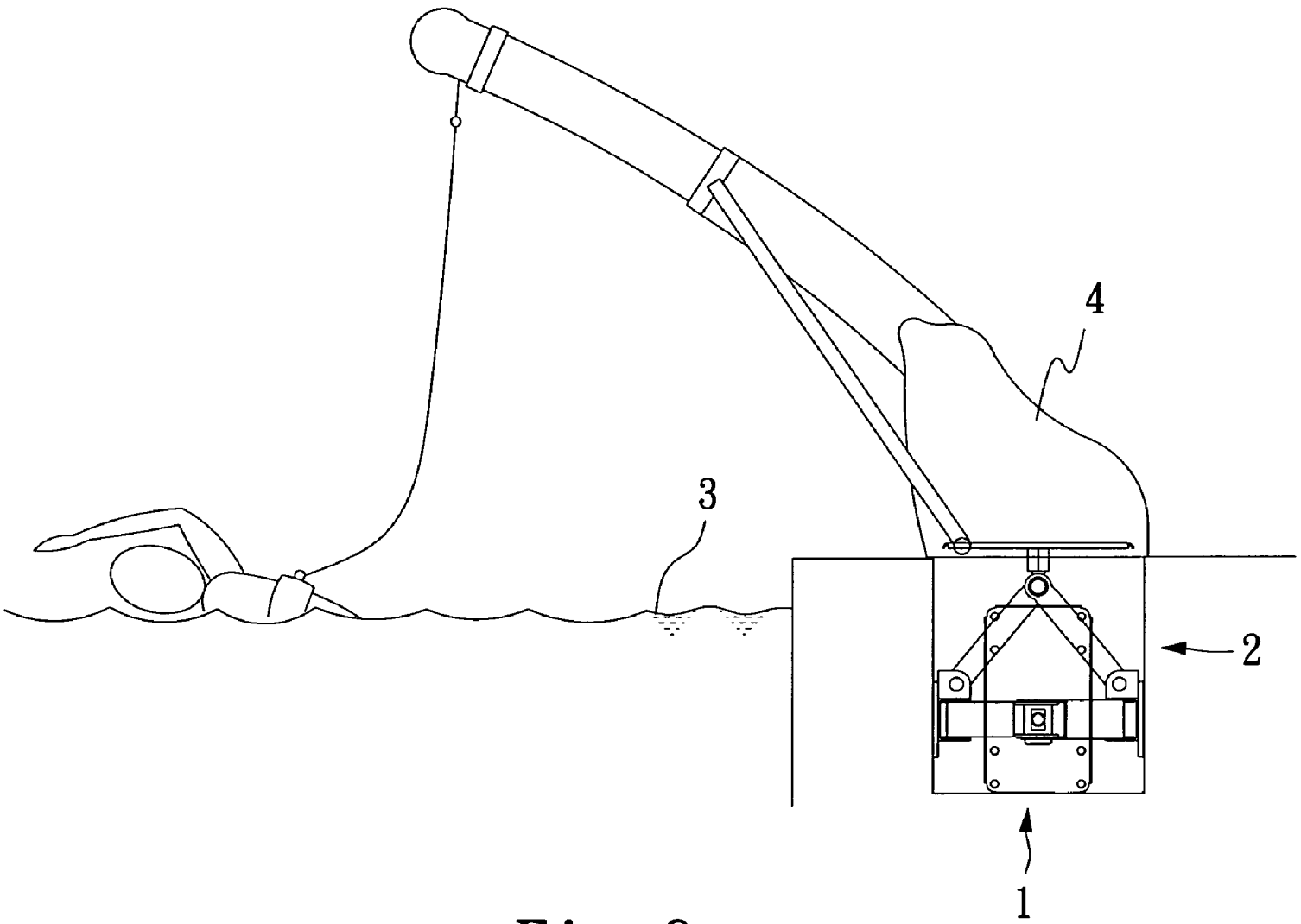
FIG. 6 is a sectioned side view showing the mounting base of FIG. 1 is fixed to a swimming pool gutter and has a swimming training machine mounted thereon.

FIG. 6 is a sectioned side view showing a mounting base 1 of the present invention is fixed to the gutter 2 surrounding the swimming pool 3, and a swimming training machine 4 is mounted to a top of the carrier plate 15 or 18. Since the mounting base 1 may be freely moved and fixed to different places in the gutter 2, the swimming training machine 4 and the like can be conveniently mounted to or changed to any desired position along the perimeter of the swimming pool 3 via the mobile mounting base 1 without adversely affecting the environmental safety and pleasant appearance of the swimming pool 3.

In the mounting base 1 of the present invention, four of six fixing arms 12 form a four-bar mechanism defining two diagonals, so that the two fixing plates 11 located at two opposite ends of one diagonal can be firmly pressed against or separated from two inner wall surfaces of the gutter 2 simply by adjusting the other diagonal via the adjusting rod 14, making the present invention novel and improved for use. With the above arrangements, the mounting base 1 is highly mobile for easy fixing to any desired point along the swimming pool gutter 2 to carry and support different water activity facilities. The present invention is therefore convenient, safe, and practical for use to meet market demands.

What is claimed is:

1. A mounting base for fixing to swimming pool perimeter, comprising:

two fixing plates;

a first set of two fixing arms, which are pivotally connected at respective first end to each other to form a first pivot point thereat, on which a through hole is provided, and separately pivotally connected at respective second end to an inner side of the two fixing plates;

a second set of two fixing arms, which are pivotally connected at respective first ends to each other to form another first pivot point thereat, on which an internally threaded through hole is provided, and separately pivotally connected at respective second ends to an inner side of the two fixing plates;

an adjusting rod being provided at an end with a push head and at the other opposite end with an externally threaded section; and a first carrier plate associated with the push head of the adjusting rod;

whereby when the adjusting rod is turned at the push head, the threaded section of the adjusting rod is extended through the through hole and screwed into the threaded hole on the two first pivot points with the push head pushed against the first pivot point of the first set of two fixing arm, and the two fixing plates are moved outward to firmly press against two opposite inner wall surfaces of a gutter extended along the swimming pool perimeter, bringing the mounting base to be fixed to the gutter with the first carrier plate ready for carrying or supporting a water activity facility and the like thereon.

2. The mounting base for fixing to swimming pool perimeter as claimed in claim 1, wherein the two fixing plates are provided on respective outer side with a coarsened surface.

3. The mounting base for fixing to swimming pool perimeter as claimed in claim 1, wherein the push head of the adjusting rod has a hexagonal cross section.

4. The mounting base for fixing to swimming pool perimeter as claimed in claim 1, further comprising a third set of two fixing arms, which are pivotally connected at respective first end to each other to form a second pivot point thereat, and separately pivotally connected at respective second end to the inner side of the two fixing plates; and a second carrier plate being connected to the second pivot point; such that the first and the second carrier plate are movable at the same time but in two perpendicular directions.

5. The mounting base for fixing to swimming pool perimeter as claimed in claim 4, wherein the second pivot point is provided with a connecting head, and the second carrier plate is connected to the second pivot point by associating with the connecting head.

6. The mounting base for fixing to swimming pool perimeter as claimed in claim 5, wherein the connecting head has a hexagonal cross section.

7. The mounting base for fixing to swimming pool perimeter as claimed in claim 5, wherein the first carrier plate is provided at a predetermined position with a fixing opening and a fixing slot extended from and communicable with one side of the fixing opening, and the push head of the adjusting rod is provided with an annular groove; and the annular groove being moved into the fixing slot on the first carrier plate via the fixing opening to engage with the fixing slot, enabling the first carrier plate to associate with the push head.

8. The mounting base for fixing to swimming pool perimeter as claimed in claim 5, wherein the second carrier plate is provided at a predetermined position with a fixing opening and a fixing slot extended from and communicable with one side of the fixing opening, and the connecting head at the second pivot point is provided with an annular groove; and the annular groove being moved into the fixing slot on the second carrier via the fixing opening to engage with the fixing slot, enabling the second carrier plate to associate with the connecting head.

* * * * *